United States Patent [19]

Mitsuyama et al.

[11] 4,332,457

[45] Jun. 1, 1982

[54] FIXING DEVICE FOR FIXING IMAGES OF AN ORIGINAL DOCUMENT ON PLAIN PAPER COPY SHEETS

[75] Inventors: Akira Mitsuyama; Tadaaki Kawano, both of Nara; Tutomu Kato, Yamatokoriyama; Masanobu Deguchi, Yamatotakada; Ituro Katoh, Nara, all of Japan

[73] Assignee: Sharp Kabushiki Kaisha, Osaka, Japan

[21] Appl. No.: 165,340

[22] Filed: Jul. 2, 1980

Related U.S. Application Data

[63] Continuation of Ser. No. 897,704, Apr. 19, 1978, abandoned.

[30] Foreign Application Priority Data

Apr. 22, 1977 [JP] Japan ..... 52/47038

[51] Int. Cl.[3] ..... G03G 15/00

[52] U.S. Cl. ..... 355/3 FU; 271/DIG. 2; 355/3 DD; 432/60

[58] Field of Search ..... 355/3 R, 3 FU, 3 DD; 430/105, 107, 109, 111; 432/60; 162/138; 427/121; 271/DIG. 2

[56] References Cited

U.S. PATENT DOCUMENTS

| | | | |
|---|---|---|---|
| 2,975,758 | 3/1961 | Bird, Jr. | 118/657 |
| 3,450,402 | 6/1969 | Weiler | 271/DIG. 2 |
| 3,584,601 | 6/1971 | Turner | 118/657 |
| 3,608,515 | 9/1971 | Tobias | 118/676 |
| 3,640,247 | 2/1972 | Mason et al. | 118/657 |
| 3,645,770 | 2/1972 | Flint | 355/3 R X |
| 3,652,315 | 3/1972 | Matsuo et al. | 252/62.1 P X |
| 3,653,894 | 4/1972 | Levy et al. | 162/138 X |
| 3,704,662 | 12/1972 | Johnson et al. | 354/318 |
| 3,806,355 | 4/1974 | Kaufman | 355/10 X |
| 3,820,776 | 6/1974 | Fujimoto et al. | 271/DIG. 2 |
| 3,838,054 | 9/1974 | Trachtenberg et al. | 252/62.1 P |
| 3,846,151 | 11/1974 | Roteman et al. | 427/194 |
| 3,850,663 | 11/1974 | Hagenbach | 252/62.1 P X |
| 3,854,975 | 12/1974 | Brenneman et al. | 355/3 FU X |
| 3,861,954 | 1/1975 | Funderburk | 162/138 X |
| 3,914,771 | 10/1975 | Lunde et al. | 346/74.2 |
| 3,956,562 | 5/1976 | Shibata et al. | 427/121 X |
| 3,988,061 | 10/1976 | Root | 355/3 FU X |
| 3,992,000 | 11/1976 | Martin | 271/311 |
| 4,003,335 | 1/1977 | Kurita et al. | 118/658 |
| 4,030,447 | 6/1977 | Takahashi et al. | 118/658 |
| 4,045,164 | 8/1977 | Moser | 355/3 FU X |
| 4,048,958 | 9/1977 | Nakaguchi et al. | 118/658 |
| 4,065,120 | 12/1977 | Imaizumi et al. | 271/311 |
| 4,067,295 | 1/1978 | Parker et al. | 118/653 |
| 4,080,159 | 3/1978 | Behun | 355/3 FU X |
| 4,081,571 | 3/1978 | Nishihama et al. | 430/120 |
| 4,095,883 | 6/1978 | Parker et al. | 355/3 DD |
| 4,112,867 | 9/1978 | Suzuki et al. | 118/690 |
| 4,193,376 | 3/1980 | Hamaguchi et al. | 118/658 |
| 4,210,448 | 7/1980 | Forgo | 430/107 X |
| 4,281,623 | 8/1981 | Kato et al. | 118/668 |

*Primary Examiner*—Fred L. Braun

*Attorney, Agent, or Firm*—Birch, Stewart, Kolasch & Birch

[57] ABSTRACT

A fixing device for fixing images of an original document on a copy material is provided for a plain paper copier. The fixing device comprises a pair of rollers for stressing under pressure the copy material carrying toner powder thereon. The toner powder is tightly adhered to the surface of the copy material to correspond to the images of the original document. In a preferred form, the toner powder is a pressure-fixable developing powder which consists of a wax component and a thermoplastic resin. A developing powder supplier is disposed within a developer powder reservoir for supplying developer powder to a magnet brush. A rotatable cylindrical magnet is provided within said developing powder supplier for generating a non-uniform magnetic field to stir the developer powder within the reservoir. A copy sheet stripping device is also provided which moves in synchronization with the approach of a copy sheet towards the fixing device and to move in synchronization with the separation of the copy sheet away from the fixing device.

5 Claims, 5 Drawing Figures

FIXING DEVICE FOR FIXING IMAGES OF AN ORIGINAL DOCUMENT ON PLAIN PAPER COPY SHEETS

This application is a continuation of copending application Ser. No. 897,704, filed on Apr. 19, 1978, now abandoned.

BACKGROUND OF THE INVENTION

The present invention relates generally to a fixing device for use in a copier and, more particularly, to a fixing device for fixing images of an original document on plain paper copy sheets for use in a plain paper copier (PPC).

The plain paper copiers have been recently developed, wherein a heating-fixing device is provided for fixing the images of the original documents on plain paper copy sheets. However, it is required that the heating-fixing device be so large to facilitate the solution of a toner powder. The occurrence of a jam within the plain paper copier has a tendency to fire a plain paper copy sheet. Pre-heating for the heating-fixing device is further required to operate the fixing device in stable conditions for a predetermined period of time in response to the application of power energy for the plain paper copier for copy purposes.

Therefore, it is desired that a fixing device shall not be preheated. On the other hand, non-heating fixing devices for fixing images of original documents on light-sensitive sheets of copy material are well known in the prior art. One such device is disclosed in J. Roteman et al., U.S. Pat. No. 3,846,151 entitled "FIXING DEVICE" issued on Nov. 5, 1974. However, it is commercially and practically impossible to realize the non-heating fixing device in the plain paper copier.

OBJECTS AND SUMMARY OF THE INVENTION

With the foregoing in mind, it is a primary object of the present invention to provide a new and improved fixing device for use in a plain paper copier.

It is another object of the present invention to provide a new and improved fixing system for use in a plain paper copier to thereby facilitate fixing of images of an original document on a plain paper copy sheet for use in a plain paper copier.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a fixing device is provided within a plain paper copier for fixing of images of an original document on a plain paper copy sheet. A developing powder is adhered to the surface of the plain paper copy sheet to correspond to an image of the original document.

In a preferable form of the present invention, the developing powder comprises a wax component and a thermoplastic resin. This developing powder is flowable, pressure-fixable, and dry powder. An example of such developing powder is disclosed in the above U.S. Pat. No. 3,925,219. Preferably, the resistance value of the developing powder is selected in the order of $10^{13}$–$10^{14}\Omega$/cm.

BRIEF DESCRIPTION OF THE DRAWINGS

Other objects and novel features of the present invention are set forth in the appended claims and the present invention as to its organization and its mode of operation will best be understood from a consideration of the following detailed description of the preferred embodiments taken in connection with the accompanying drawings, wherein:

DESCRIPTION OF THE PREFERRED EMBODIMENT

Figure 1:
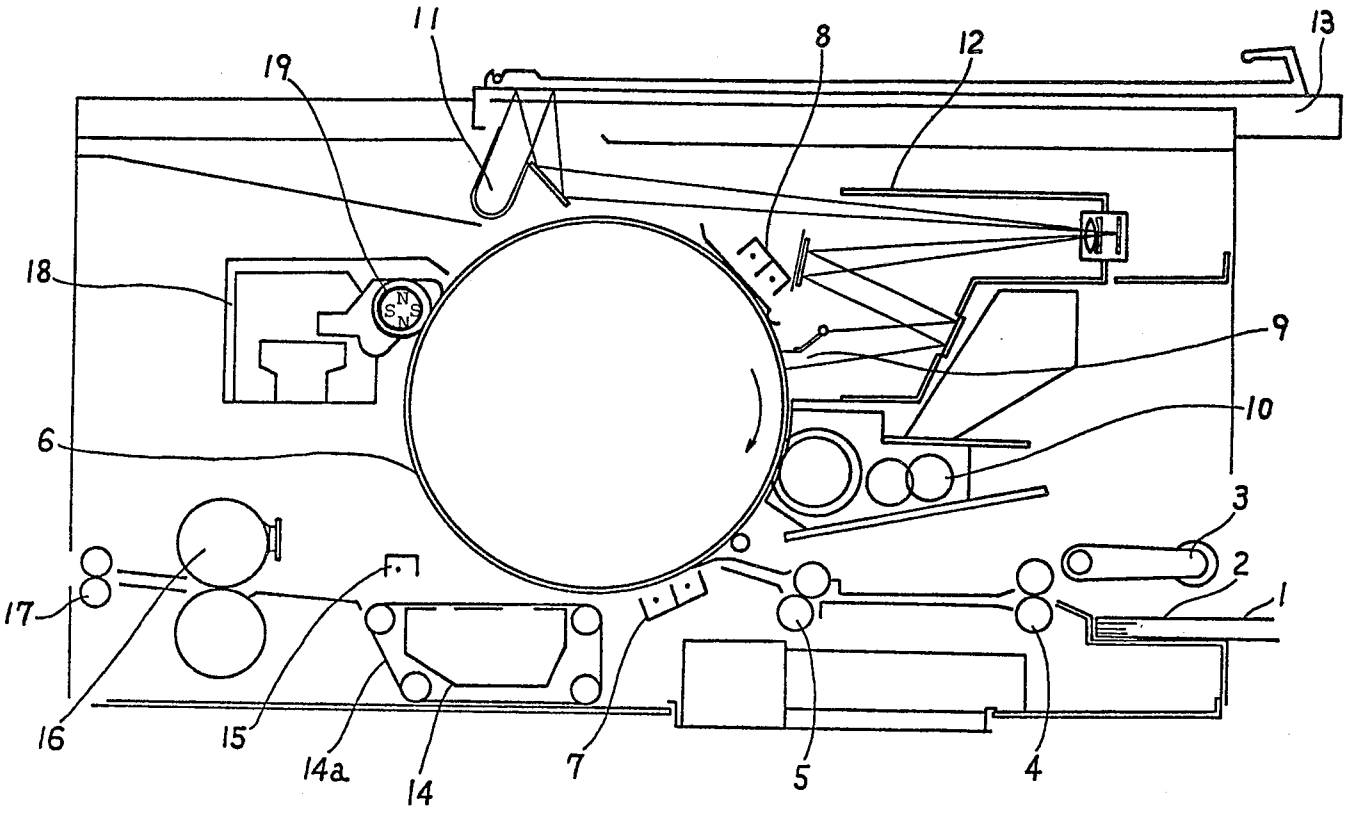
FIG. 1 is a diagrammatic cross-sectional view of a plain paper copier according to the present invention.

FIG. 1 shows a plain paper copier of the present invention, wherein a pair of fixing rollers 16 are provided for fixing under pressure images of an original document on a plain paper copy sheet 2.

The plain paper copy sheet 2 passes through a paper feeding section, a transference section and a fixing section and the copied sheet 2 is discharged from a paper outlet as described hereinbelow.

A plurality of the plain paper copy sheets 2 are stacked within a cassette 1. A feed roller 3 is positioned on the plain paper copy sheets 2 to transfer the copy sheets 2 into the housing of the plain paper copier in response to a copy start signal applied thereto.

The plain paper copy sheet 2 picked up by the feed roller 3 is transferred into a developing section as described below by a pair of feed rollers 4 and other feed rollers 5. An image of an original document is produced on a light sensitive member 6 in the form of a toner powder pattern. The image is developed on the plain paper copy sheet 2 using a transference charger 7. The light sensitive member 6 comprises a master paper including a zinc oxide coating tightly adhered to a rotary drum.

Around the light sensitive member 6 there are provided a charger 8 for charging the surface of the light sensitive member 6, an exposure section 9 for projecting reflection light from the original document toward the drum and a developing section 10 for developing the reflection light images on the light sensitive member 6 by depositing toner powder corresponding to the reflection light images thereon. The reflection light image is formed by applying light from an illumination section 11 upon the original document. The original document is disposed on a transparent plate such as a glass plate. The reflection light passes an optical system 12 to provide the reflection light images on the exposure part 9. A document plate 13 including the transparent plate is removed in accordance with the rotation of the drum to achieve slit exposure as is well known.

The toner powder employed within the plain paper copier of the present invention is a flowable, pressure-fixable developing dry powder comprising wax and thermoplastic resin. Preferably, the resistance value of the toner powder is selected in the order of $10^{13}$–$10^{14}$ Ω/cm.

Figure 2:
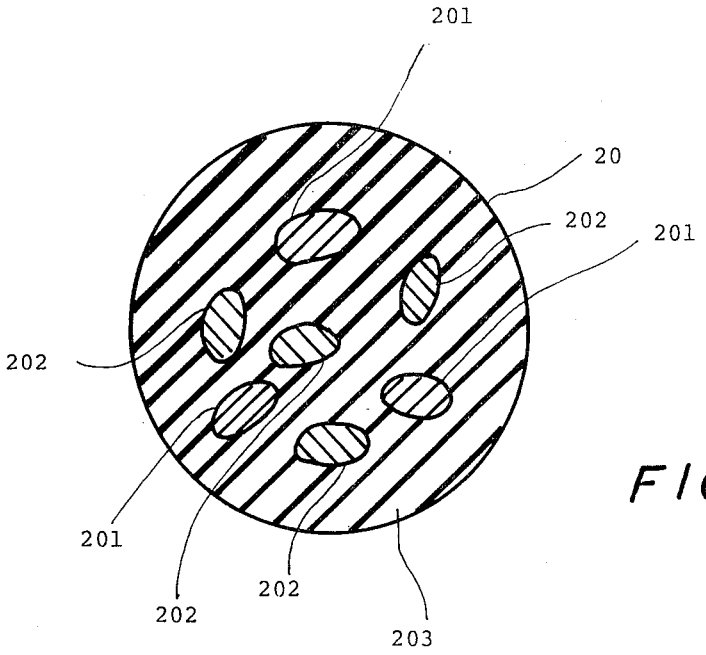
FIG. 2 is a cross-sectional view of an example of developing powder adapted to the plain paper copier shown in FIG. 1.

FIG. 2 shows the toner powder having the resistance value of $10^{13}$–$10^{14}$Ω/cm in a cross-sectional view. The toner powder 20 comprises, for example, 55.6% of magnetite powder 201, 7.4% of conductive carbon black 202 and 37% of low molecular weight polyethylene resin 203. The diameter of the toner powder grain is 15μ.

The toner powder is transferred to the developing section 10 by the magnetically attractive force of a magnet roller within the developing section 10. In the developing section 10, the toner powder images formed on the light sensitive member 6 are developed on the plain paper copy sheet 2 through the transference charger 7. Assume now that the transference charger 7 is charged with polarity opposite to that of the charger 8. The plain paper copy sheet 2 is strictly adhered to the light sensitive member 6 for the transference purposes.

A paper suction member 14 is provided for sucking the plain paper copy sheet 2 with air therein for removal from the light sensitive sheet 6. The plain paper copy sheet 2 is then placed on the travelling course of a belt 14*a* while carrying the toner powder images thereon. A charge removal component 15 is disposed above the paper suction member 14 for removing the remaining charge on the plain paper copy sheet 2.

When the plain paper copy sheet 2 reaches fixing rollers 16, the belt 14*a* presses the toner powder strongly on to the copy sheet 2 for adhesion purposes. The fixing rollers 16 can be implemented in a well known manner such as in U.S. Pat. No. 3,846,151 entitled "FIXING DEVICE" to J. Roteman et al. The toner powder images are strictly fixed on the plain paper copy sheet 2. After passing through the fixing rollers 16, the plain paper copy sheet 2 is sent to feed rollers 17 to be discharged out of the housing of the plain paper copier.

A cleaner 18 is provided in the neighborhood of the drum for removing the remaining toner powder which has not been adhered to the plain paper copy sheet 2 from the surface of the light sensitive member 6 during the transference procedure. The cleaner 18 comprises a magnet roller 19 which magnetically attracts the toner powder in accordance with the rotation thereof such as the developing section 10. A cleaner brush can be employed instead of the magnet cleaner 18.

Some advantages of the plain paper copier in accordance with the present invention are summarized as follows, which can not be expected in a prior art plain paper copier.

(1) The fixing process of the present invention does not rely upon heat energy thereby overcoming the heat problems inherent with the fixing device. A pre-heating period is not required to speed up copying operation.

(2) The present copier is free of danger such as firing the plain paper copy sheet 2 because of the absence of a heater.

(3) The dry toner powder adapted to the present invention is useful for the fixing process, which toner powder comprises a wax component and a thermoplastic resin. Using the toner powder, carrier elements which are inevitably utilized in the prior art toner powder are omitted. Of course, the present invention needs replenishment of such carrier elements.

(4) Using the plain paper copy sheet 2 enables a substantial reduction in copy cost and any character or mark can be written directly on the copy material 2 after copying.

Many problems must be solved to realize the pressure fixing method in the plain paper copier of the present invention as described below. For the purpose of this invention "plain paper" means a paper having no light-sensitive coating as is well known in the art of copiers.

(I) How to apply the developing powder comprising a wax component and thermoplastic to the plain paper copier of the present invention.

When the conventional plain paper copier is activated using the conventional developing powder having resistance of $10^{7}$–$10^{8}$Ω/cm, the copy produced might be damaged, especially, smeary or scattered copied images result during the transference procedure. The reasons therefor have not yet been revealed.

To enhance the transference efficiency, the resistance value of the developing toner must amount to $10^{13}$–$10^{14}$Ω/cm, and simultaneously, the volume specific resistance of the plain paper is increased above $1\times10^{12}$Ω/cm under relative humidity of 10–90% at room temperature. To make a plain paper copy sheet adaptable to the purpose of the present invention it is desirable that a plain paper copy sheet be impregnated or coated with one or more of highly polymerized compound solutions such as acrylic ester resin, alkyd resin, epoxide resin, urethane resin, polyolefine resin, polystyrene resin, melamine resin, urea resin, and vinyl chloride resin.

However, the developing efficiency is necessarily reduced because of the higher resistance value of the developing powder. Therefore, an improvement in the developing section is preferable for this reason as follows.

(1) The outer diameter of the magnet roller in the developing section is enlarged.

Figure 3:
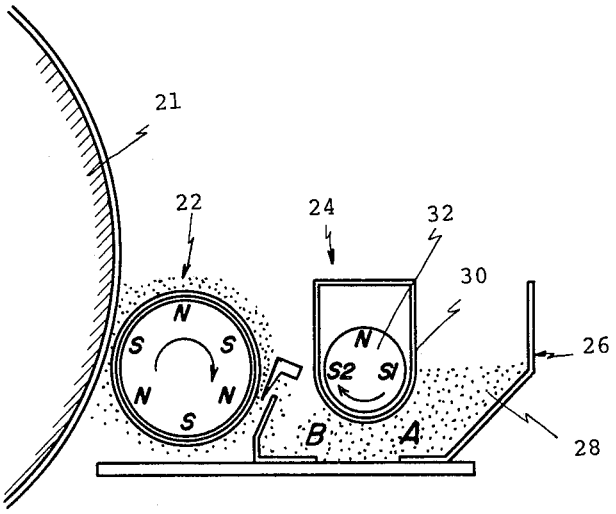
FIG. 3 is a sectional view of a developing system incorporated within the plain paper copier shown in FIG. 1.

(2) A developer powder supply means in the developing section comprises a stationary sleeve and a rotatable cylindrical magnet enclosed by the stationary sleeve. The details of the stationary sleeve and the rotatable cylindrical magnet are described in the copending patent application Ser. No. 854,212 entitled "DEVELOPER POWDER SUPPLY IN MAGNET BRUSH DEVELOPMENT" filed Nov. 23, 1977, now U.S. Pat. No. 4,193,376. The corresponding West German Application was filed on Nov. 24, 1977 under No. P 27 52 561.7. Within such an arrangement a sleeve is stationary and the cylindrical magnet is rotatable unlike a conventional copier. In FIG. 3 a developer powder supply means 24 is disposed within a developer reservoir 26 for supplying developer powder 28 to a magnet brush developing roller 22 which is placed adjacent to a drum 21 carrying an electrostatic latent image formed on the surface thereof.

The developer powder supply means 24 comprises a stationary sleeve 30 and a rotatable cylindrical magnet 32 enclosed by the stationary sleeve 30. The rotatable cylindrical magnet 32 includes a magnet shunt means or has an odd number of magnetic poles to produce distorted distribution of the magnetic field. The rotatable cylindrical magnet 32 generates a nonuniform magnetic field therearound and includes a surface portion which essentially does not have a magnetic field. The surface portion which essentially does not include a magnetic field is rotatable in response to the rotation of the cylindrical magnet for supplying the developer powder in a swinging movement causing the stirring of the developer powder within the reservoir 26. The stationary sleeve 30 has an extended portion which is placed above the rotatable cylindrical magnet 32, where the magnetic field established by the rotatable cylindrical magnet 32 does not effect the developer powder 28.

Finally, with respect to the improvement in the developing section, to make the developing period much longer and enhance substantially the developing efficiency, the outer diameter of the stationary sleeve is selected in the order of 58–59 mm $\phi$, while the conventional sleeve has 51 mm $\phi$ at the same portion.

(II) How to adapt the fixing device into the plain paper copier of the present invention.

During operation of the fixing device static energy was inevitably caused on the plain paper and the developing toner, both having the higher resistance value as viewed in the prior art. A paper stripping member was provided within the fixing device for scrapping the plain paper copy sheet. The paper stripping member undesirably also stripped the developing toner which had been adhered to the fixing device, for example, a pair of fixing rollers. The stripped developing toner made the plain paper dirty because of an accumulation of toner on the plain paper in accordance with the static energy therebetween.

Figure 4:
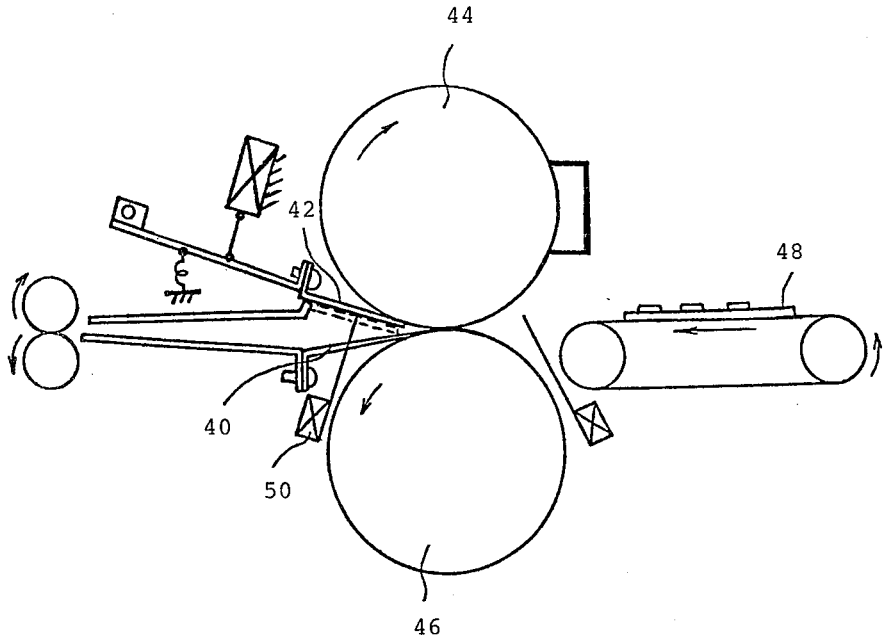
FIGS. 4 and 5 are side views of copy stripping mechanisms incorporated within the plain paper copier shown in FIG. 1.
Figure 5:
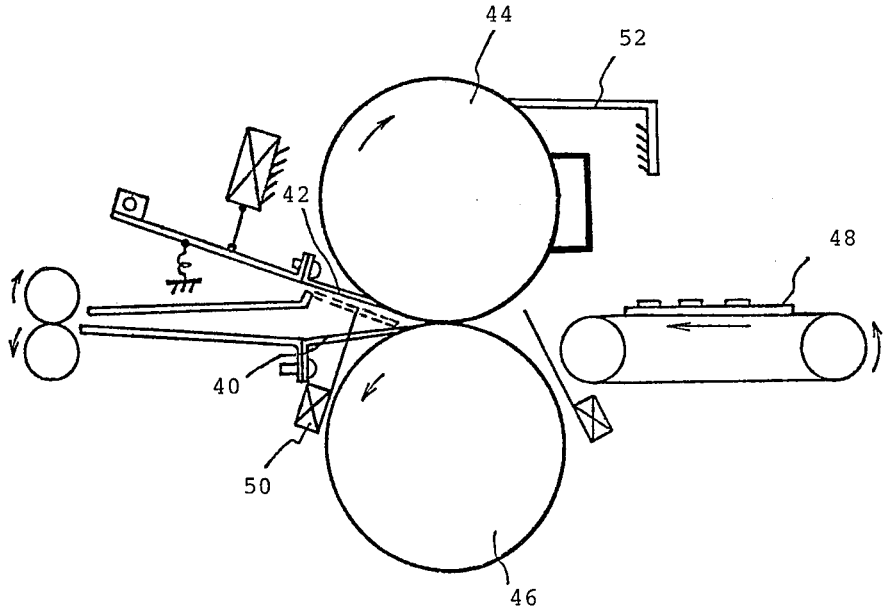

Contrarily, according to the present invention, the paper stripping member is preferably movably secured adjacent to the fixing device. Such paper stripping member is disclosed in the copending U.S. patent application entitled "SHEET STRIPPING MEMBERS FOR FIXING DEVICE FOR FIXING IMAGES OF AN ORIGINAL DOCUMENT ON SHEETS OF COPY MATERIALS BY USING TWO ROLLERS IN PRESSURE ENGAGEMENT" Ser. No. 891,639 filed on Mar. 30, 1978 now U.S. Pat. No. 4,281,623. The corresponding West German patent application was filed on Mar. 30, 1978 under the Ser. No. P 28 13 777.1. As disclosed therein, in FIGS. 4 and 5 a couple of copy sheet stripping members 40 and 42 are provided for scraping away a copy sheet adhered strictly to one of two rollers 44 and 46 which are driven to fix images of an original document on a copy sheet 48 by pressure engagement. At least one of the copy sheet stripping members 40 and 42 is movably secured adjacent to the roller 44 while the copy sheet 48 is not transferred out of the rollers 44 and 46. The copy sheet stripping member becomes pressed against the roller 44 when the copy sheet 48 is transferred to the roller and is detected by a forward sensing means. The copy sheet stripping member 42 is free of residue attached to the roller 44 because of the period of time whereby the roller 44 is engaged with the copy sheet stripping 42. The member 52 can be further disposed to assure both the scraping of the copy sheet 48 and the removal of the residue on the roller 44, the copy sheet stripping member 52 being continuously pressed against the roller 44.

The operation of the copy sheet stripping member 42 is synchronized to move into engagement with the roller 44 when a first sensing means produces an output sensing the approach of a copy sheet 48 to scrape the copy sheet 48 from the roller 44. The copy sheet stripping member 42 is synchronized to move out of engagement with the roller 44 when a second sensing means 50 produces an output sensing the copy sheet 48 upon completion of the scraping of the copy sheet 48 from the roller 44.

While only certain embodiments of the present invention have been described, it will be apparent to those skilled in the art that various changes and modifications may be made therein without departing from the spirit and scope of the invention as claimed.

What is claimed is:

1. In an electrostatic plain paper copier wherein charging and light exposure is carried through onto a light-sensitive member to form an electrostatic latent image thereon, said electrostatic latent image being developed in the form of a toner image through a developing station including a magnetic brush, said toner image being transferred onto a plain paper copy sheet and fixed via a fixing device and further comprising:

toner used as a developing agent in said developing station comprising a flowable, pressure-fixable dry powder containing magnetite and having a resistance value greater than or equal to $10^{13}$ ohm/cm;

said fixing device comprising a pair of pressure roller means for firmly pressing said imaged toner onto the plain copy sheet thereby fixedly securing said toner to said plain paper copy sheet;

a magnetic brush developing roller for developing said image; and a developer powder supplier disposed within a developer powder reservoir for supplying the developer powder to said magnetic brush developing roller, said developer powder supplier including:

a rotatable cylindrical magnet for generating a non-uniform magnetic field therearound and including a surface portion of said rotatable cylindrical magnet which essentially does not have a magnetic field and said portion being rotatable in response to rotation of said cylindrical magnet for supplying said developer powder in a swinging movement causing the stirring of said developer powder within said reservoir; and a stationary non-magnet sleeve enclosing said rotatable cylindrical magnet.

2. In an electrostatic plain paper copier wherein charging and light exposure is carried through onto a light-sensitive member to form an electrostatic latent image being developed in the form of a toner image through a developing station including a magnetic brush, said toner image being transferred onto a plain copy sheet and fixed to said plain paper copy sheet via a fixing device and further comprising:

toner used as a developing agent in said developing station comprising a flowable, pressure-fixable dry powder containing magnetite and having a resistance value greater than or equal to $10^{13}$ ohm/cm;

said fixing device comprising a pair of pressure roller means for firmly pressing said imaged toner onto the plain copy sheet thereby fixedly securing said toner to said plain paper copy sheet;

a copy sheet stripping device for scraping the plain paper copy sheet adhered to the fixing device; and means for pressing said copy sheet stripping device against said fixing device only in synchronization with an output from a first sensing means for sensing the approach of a plain paper copy sheet towards the fixing device and for scraping said plain paper copy sheet from said fixing device when said toner image is transferred to said plain paper copy sheet and for spacing said copy sheet stripping device apart from said fixing device in synchronization with an output from a second sensing means for sensing the completion of the scraping of said plain paper copy sheet from said fixing device and during periods of time when no copy sheet is being processed through said fixing device.

3. An electrostatic plain paper copier according to claim 1, or 2, wherein the toner has a resistance value between $10^{13}$ to $10^{14}$ ohm/cm.

4. An electrostatic plain paper copier according to claim 1, or 2, wherein the volume specific resistance of the plain paper copy sheet is above $10^{12}$ ohm/cm under a relative humidity of 10–90 percent at room temperature.

5. In an electrostatic plain paper copier wherein charging and light exposure is carried through onto a light-sensitive member to form an electrostatic latent image being developed in the form of a toner image through a developing station including a magnetic brush, said toner image being transferred onto a plain paper copy sheet and fixed to said plain paper copy sheet via a fixing device means and further comprising:

toner used as a developing agent in said developing station comprising a flowable, pressure-fixable dry powder containing magnetite and having a resistance value greater than or equal to $10^{13}$ ohm/cm; and said fixing device means comprising a pair of pressure roller means for firmly pressing said imaged toner onto the plain paper copy sheet thereby fixedly securing said toner to said plain paper copy sheet;

a copy sheet stripping device for scraping the plain paper copy sheet adhered to the fixing device;

said plain paper copy sheet having a sufficiently high volume specific resistance to produce an electrostatic energy in both said copy sheet and in toner attached to the copy sheet stripping device so that toner adhering to said stripping device is dislodged onto the copy sheet by the electrostatic energy; and means for pressing said copy sheet stripping device against said fixing device only in synchronization with an output from a first sensing means for sensing the approach of a plain paper copy sheet towards the fixing device and for scraping said plain paper copy sheet away from said fixing device when said toner image is transferred to said plain paper copy sheet and for spacing said copy sheet stripping device apart from said fixing device in synchronization with an output from a second sensing means for sensing the completion of the scraping of said plain paper copy sheet from said fixing device and during periods of time when no copy sheet is being processed through said fixing device;

wherein when said copy sheet stripping device is displaced away from said fixing device, toner adhering to the stripping device is prevented from falling on said copy sheet.

* * * * *